US006537610B1

(12) United States Patent
Springer et al.

(10) Patent No.: US 6,537,610 B1
(45) Date of Patent: Mar. 25, 2003

(54) METHOD FOR PROVIDING A DUAL-LAYER COATING ON AN AUTOMOTIVE SUSPENSION PRODUCT

(75) Inventors: Paul W. Springer, Aurora, OH (US); Jason Conn, Shaker Heights, OH (US); Jamie Harmon, Cleveland, OH (US); Robert Wolf, Cleveland, OH (US)

(73) Assignee: Springco Metal Coating, Inc., Cleveland, OH (US)

( * ) Notice: Subject to any disclaimer, the term of this patent is extended or adjusted under 35 U.S.C. 154(b) by 0 days.

(21) Appl. No.: 09/982,669

(22) Filed: Oct. 18, 2001

Related U.S. Application Data

(60) Provisional application No. 60/322,789, filed on Sep. 17, 2001.

(51) Int. Cl.[7] ..... B05D 1/22; B05D 1/38

(52) U.S. Cl. ..... 427/185; 427/470; 427/486; 427/203; 427/386; 427/388.1

(58) Field of Search ..... 427/459, 461, 427/470, 475, 486, 386, 388.1, 182, 185, 202, 203, 314, 318, 361, 327, 8; 118/666, 667

(56) References Cited

U.S. PATENT DOCUMENTS

| | | | | |
|---|---|---|---|---|
| 1,395,379 | A | * | 11/1921 | Adelsperger |
| 1,614,925 | A | * | 1/1927 | Hutchison |
| 1,833,317 | A | * | 11/1931 | Crawford |
| 3,513,012 | A | | 5/1970 | Point |
| 3,660,136 | A | | 5/1972 | Guilbault et al. |
| 3,669,705 | A | | 6/1972 | Morrison |
| 3,682,738 | A | * | 8/1972 | Smith |
| 3,690,298 | A | | 9/1972 | Venturi |
| 3,832,974 | A | * | 9/1974 | Adams et al. |
| 4,206,248 | A | | 6/1980 | Schmidlin |
| 4,316,939 | A | | 2/1982 | Guyomard |
| 4,507,332 | A | * | 3/1985 | Nolan et al. |
| 4,806,388 | A | * | 2/1989 | Mochizuki et al. |
| 5,000,979 | A | * | 3/1991 | Cueman et al. |
| 5,384,165 | A | | 1/1995 | Sellitto |
| 5,387,653 | A | | 2/1995 | Merval et al. |
| 5,455,080 | A | | 10/1995 | van Ooij |
| 5,620,743 | A | | 4/1997 | Harth et al. |
| 5,834,067 | A | | 11/1998 | Rodely |
| 5,891,515 | A | * | 4/1999 | Dutheil et al. |
| 5,916,639 | A | | 6/1999 | Ichikawa |
| 5,981,086 | A | * | 11/1999 | Siminski |
| 6,001,427 | A | | 12/1999 | Breazeale |
| 6,020,034 | A | * | 2/2000 | Akki et al. |
| 6,025,035 | A | * | 2/2000 | Seo et al. |
| 6,042,892 | A | | 3/2000 | Kim et al. |
| 6,124,000 | A | | 9/2000 | Brimer et al. |
| 6,200,678 | B1 | | 3/2001 | Hunt et al. |
| 6,245,391 | B1 | | 6/2001 | Kawai et al. |
| 6,284,311 | B1 | | 9/2001 | Gregorovich et al. |

FOREIGN PATENT DOCUMENTS

| | | | |
|---|---|---|---|
| GB | 1121082 | * | 7/1968 |

OTHER PUBLICATIONS

"Fluidised Bed Powder Coating", M. Elmao, Powder Technology Publication Series No. 5, pp. 29–31, Jun. 1973.*

* cited by examiner

*Primary Examiner*—Fred J. Parker
(74) *Attorney, Agent, or Firm*—Taft, Stettinius & Hollister LLP

(57) ABSTRACT

A process for applying a dual-layer protective coating to steel suspension components of an automobile involves the steps of applying a first coat of the zinc-rich, epoxy-based coating powder to the components utilizing the conventional electrostatic application process; partially curing the layer of zinc-rich coating that has been applied to the steel components such that the zinc-rich coating is gelled; immersing the components with the first layer of gelled zinc-rich coating in a pre-heated/heated fluidized bed of thermoplastic powder so that a relative uniform layer of the thermoplastic coating powder is applied over the first coat of gelled zinc-rich coating; and finally curing the outer layer of thermoplastic powder coating and the inner layer of the zinc-rich coating.

35 Claims, 1 Drawing Sheet

METHOD FOR PROVIDING A DUAL-LAYER COATING ON AN AUTOMOTIVE SUSPENSION PRODUCT

CROSS-REFERENCE TO RELATED APPLICATIONS

The present application claims the benefit of U.S. Provisional Patent Application, Ser. No. 60/322,789, filed Sep. 17, 2001.

BACKGROUND

The present invention directed to a coating process for a dual-layer coating on a suspension component for an automobile; and more particularly, for suspension spring components.

Steel suspension components for use with automobile suspension systems are typically coated with a protective coating to protect the components from corrosion and other environmental damage. Because these components are typically subject to impact damage caused by flying stones and gravel,the automotive industry is beginning to utilize dual-layer coating systems for such suspension components, where the first layer is a zinc-rich coating that has a self-healing property when the coating is broken or damaged and an outer layer of a thermoplastic material that protects the inner layer from chipping and damage caused by objects thrown up from the road. The inner, zinc-rich layer is typically approximately 2.00 to approximately 3.00 mils and the outer coat thermoplastic layer is typically approximately 13.0 to approximately 17.0 mils. See U.S. Pat. No. 5,981,086 for more detailed information regarding the dual-coat materials.

Traditionally, the zinc-rich layer has been applied to the steel suspension component utilizing an electrostatic spray application (involving the steps of charging the zinc-rich powder with a low amp, very high voltage charge, placing the steel components on a grounded conveyor, and then spraying the components with the charged powder such that the charged powder is evenly and uniformly attracted to, and hence, applied to the grounded steel component). After the electrostatic spray application, the component is conventionally placed in an oven so that the layer of zinc-rich powder is baked onto the steel component (i.e. is cured). It is then envisioned that the outer, thermoplastic layer will be applied in a similar manner.

A problem confronted by the industry with this dual-coat process is that the thermoplastic powder is not sufficiently conductive (not electrostatic), and hence, utilizing an electrostatic coating operation for the outer, thermoplastic layer has been very problematic. The coating industry has, thus, resorted to different types of dual-layer coatings and has experimented with different types of methods for coating the outer layer. The primary problem with these alternate methods for applying the outer, thermoplastic coat is that they require a labor-intensive, manual application and are therefore very expensive to perform.

The application problems are increased with automotive components having more complex shapes, such as coil-springs. Prior-art attempts for obtaining an adequate thickness and uniformity of the thermoplastic layer on both the inner and outer diameter surfaces of the coil-spring have included over-heating the coil-spring prior to a spray application of the thermoplastic powder in an attempt to make the thermoplastic powder attract to and adhere to the inner and outer diameter surfaces of the coil-spring (i.e., relying more on the heat of the coil-spring to attract the thermoplastic powder than the electro-static properties). A problem with this attempt is that such over-heating causes the zinc-rich layer to become over-cured, which, in-turn, substantially reduces the amount of adhesion or bonding between the zinc-rich layer and the thermoplastic layer in the finished product. Additionally, in an attempt to obtain adequate thickness and uniformity on the inner diameter surfaces of the coil-spring, the outer diameter surfaces tend to become overloaded with the thermoplastic material. This increases consumption of the thermoplastic powder (increases cost) and presents possible fit problems with mating components during automobile assembly.

Accordingly, there is a need for a high-volume process for applying the dual-layer coating described above to steel suspension components that does not necessitate the use of an error-prone electrostatic spray application for the outer, thermoplastic layer of the dual-layer coating.

SUMMARY OF THE INVENTION

The present invention involves a process for applying a dual-layer protective coating to metallic suspension components of an automobile that involves the steps of applying a first coat of the zinc-rich coating powder utilizing the conventional electrostatic application process; partially curing the layer of zinc-rich coating that has been applied to the steel component such that the zinc-rich coating is gelled; immersing the component with the first layer of gelled zinc-rich coating in a fluidized bed of the thermoplastic powder so that a relative uniform layer of the thermoplastic coating powder is applied over the first coat of gelled zinc-rich coating; and finally curing the outer layer of thermoplastic powder coating and the inner layer of the zinc-rich coating.

In an exemplary embodiment, the fluidized bed of the thermoplastic powder is heated to bring the fluidized bed of thermoplastic powder within a predetermined temperature difference from the temperature of the component with just prior to the component being immersed within the fluidized bed of thermoplastic powder. In an even more detailed embodiment, the temperature of the component prior to being immersed within the thermoplastic powder and the temperature of the fluidized of thermoplastic are monitored prior to immersing the component within the fluidized bed of thermoplastic powder; and further, the heat of the fluidized bed of thermoplastic powder may be adjusted if the difference between the component and the fluidized thermoplastic deviate from the predetermined potential.

In yet a further detailed embodiment, excess thermoplastic powder is removed from the components subsequent to immersing the components within the fluidized bed of thermoplastic powder by the step of directing a stream of air or gas against the excess powder carried on the components.

Therefore, it is a first aspect of the present invention to provide a method for applying a protective coating to a steel component of a vehicle that includes the steps of: applying a first coat of epoxy-based, protective powder to the component; partially curing the first coat; heating a fluidized bed of thermoplastic powder; immersing the component with the partially cured first coat into the heated fluidized bed of thermoplastic powder so as to apply a second coat of the thermoplastic powder over the first coat; withdrawing the component from the fluidized bed; and finally curing the first and second coats. In a detailed embodiment the fluidized bed of thermoplastic powder is heated to bring the fluidized bed of thermoplastic powder within a predetermined temperature difference from the temperature of the component at a time just prior to the immersing step. In a further detailed embodiment, the method further includes the steps of: monitoring the temperature difference between the fluidized bed of thermoplastic powder and the component at the time just prior to the immersing step; and responsive to the monitoring step, adjusting at least one of the temperature of the fluidized bed of thermoplastic powder and the temperature of the component at the time just prior to the immersing step. In yet a further detailed embodiment, the adjusting step is performed automatically; or, alternatively, the adjusting step is performed, at least in part, manually.

In an alternate detailed embodiment of the first aspect of the present invention, the predetermined temperature difference is approximately 60° F. to approximately 75° F. In another alternate detailed embodiment of the first aspect of the present invention, the temperature of the component at the time just prior to the immersing step is approximately 140° F. to approximately 230° F. and the temperature of the fluidized bed of thermoplastic powder is approximately 90° F. to approximately 180° F. In a further detailed embodiment, the temperature of the component at the time just prior to the immersing step is approximately 200° F. to n approximately 210° F. and the temperature of the fluidized bed of thermoplastic powder is approximately 135° F. to approximately 145° F.

In an alternate detailed embodiment of the first aspect of the present invention, the partially curing step includes the step of heating the component with the first coat applied thereto in an oven at a predetermined temperature for a predetermined period of time. In a further detailed embodiment, the method further includes the steps of: monitoring a sum of the oven temperature and the temperature of the fluidized bed of thermoplastic powder; and maintaining the sum of the oven temperature and the temperature of the fluidized bed of thermoplastic powder within a predetermined temperature range. In yet a further detailed embodiment, the maintaining step includes the step of responsive to the monitoring step, adjusting at least one of the oven temperature and the temperature of the fluidized bed of thermoplastic powder. In an alternate detailed embodiment, the predetermined temperature range is approximately 430° F. to approximately 455° F.

In another alternate detailed embodiment of the first aspect of the present invention, the method further includes the step of monitoring a sum of the component temperature at the time just prior to the immersing step and the temperature of the fluidized bed of thermoplastic powder; and maintaining the sum of the component temperature at the time just prior to the immersing step and the temperature of the fluidized bed of thermoplastic powder within a temperature range. In a further detailed embodiment, the maintaining step includes the step of responsive to the monitoring step, adjusting at least one of the oven temperature and the temperature of the fluidized bed of thermoplastic powder. In a further detailed embodiment, the predetermined temperature range is approximately 325° F. to approximately 340° F.

In another alternate detailed embodiment of the first aspect of the present invention the step of heating the fluidized bed of thermoplastic powder includes the steps of injecting a gas into the fluidized bed heating the gas prior to the injecting step. In a further detailed embodiment, the injecting step also performs, at least in part, the step of fluidizing the thermoplastic powder contained within the bed.

In another alternate detailed embodiment of the first aspect of the present invention the step of heating the fluidized bed of thermoplastic powder includes the step of repeatedly immersing heated components into the fluidized bed of thermoplastic powder. In a further detailed embodiment, the step of heating the fluidized bed of thermoplastic powder includes the step of repeatedly immersing groups of the heated components into the fluidized bed of thermoplastic powder.

In another alternate detailed embodiment of the first aspect of the present invention, the step of heating the fluidized bed of thermoplastic powder includes the steps of injecting a gas into the fluidized bed, heating the gas prior to the injecting step and repeatedly immersing groups of the heated components into the fluidized bed of thermoplastic powder.

In another alternate detailed embodiment of the first aspect of the present invention, the heating step includes the step of pre-heating the fluidized bed of thermoplastic powder and the method further includes the step of maintaining the fluidized bed of thermoplastic powder at a predetermined temperature range. In a further detailed embodiment, the predetermined temperature range is dependent, at least in part, upon the temperature of the component at a time just prior to the immersing step. In an alternate detailed embodiment, the partially curing step includes the step of heating the component with the first coat in an oven for a predetermined period of time; and during the preheating step, the temperature of the oven is adjusted according, at least in part, to the temperature of the fluidized bed of thermoplastic powder. In an alternate detailed embodiment, the pre-heating step pre-heats the fluidized bed of thermoplastic powder to a temperature of approximately 90° F. to approximately 180° F.

In another alternate detailed embodiment of the first aspect of the present invention, the method further includes the step of, during or after the withdrawing step, removing excess of the thermoplastic powder from the component. In a further detailed embodiment, the removing step includes the step of directing at least one stream of gas against the component.

In another alternate detailed embodiment of the first aspect of the present invention, the first coat of epoxy-based, protective powder is a zinc-rich epoxy-based, protective powder.

In another alternate detailed embodiment of the first aspect of the present invention, each of the steps are respectively performed in stages on a group of the components. In a further detailed embodiment the method further includes the step of sequentially delivering multiple groups of the components to the respective stages. In yet a further detailed embodiment, the delivering step is performed, in most part, by a conveyor system.

It is a second aspect of the present invention to provide a batch method for applying a protective coating to multiple groups of metallic components for a vehicle that includes the steps of: applying a first coat of epoxy-based, protective powder to a group of the components at a first coat station; partially curing the first coat on the group of the components at a gelling station; pre-heating a fluidized bed of thermoplastic powder; immersing the group of the components with the partially cured first coat into the pre-heated fluidized bed of thermoplastic powder so as to apply a second coat of the thermoplastic powder over the first coat at a second coat station; and finally curing the first and second coats on the group of components, at least in part, at a curing station. In a further detailed embodiment, the fluidized bed of thermoplastic powder is pre-heated to bring the fluidized bed of thermoplastic powder within a predetermined temperature difference from the temperature of the group of components as detected between the gelling station and the second coat station. In a further detailed embodiment, the batch method further includes the steps of: monitoring the temperature difference between the fluidized bed of thermoplastic powder and the group of components as detected between the gelling station and the second coat station; and responsive to the monitoring step, adjusting at least one of the temperature of the fluidized bed of thermoplastic powder and the temperature of the group of components as detected between the gelling station and the second coat station. In yet a further detailed embodiment, the adjusting step is performed automatically; or is performed, at least in part, manually. In an alternate detailed embodiment, the predetermined temperature difference is approximately 60° F. to approximately 75° F.

In an alternate detailed embodiment of the second aspect of the present invention, the temperature of the component between the gelling station and the second coat station is approximately 140° F. to approximately 230° F. and the temperature of the fluidized bed of thermoplastic powder is approximately 90° F. to approximately 180° F. In a further detailed embodiment, the temperature of the component between the gelling station and the second coat station is approximately 200° F. to approximately 210° F. and the temperature of the fluidized bed of thermoplastic powder is approximately 135° F. to approximately 145° F.

In an alternate detailed embodiment of the second aspect of the present invention, the gelling station utilizes a gelling oven at a predetermined temperature for a predetermined period of time. In a further detailed embodiment, the batch method further includes the steps of: monitoring a sum of the gelling oven temperature and the temperature of the fluidized bed of thermoplastic powder; and maintaining the sum of the gelling oven temperature and the temperature of the fluidized bed of thermoplastic powder within a predetermined temperature range. In yet a further detailed embodiment, the maintaining step includes the step of responsive to the monitoring step, adjusting at least one of the gelling oven temperature and the temperature of the fluidized bed of thermoplastic powder. In an alternate detailed embodiment, the predetermined temperature range is approximately 435° F. to approximately 455° F. In another alternate detailed embodiment, the batch method further includes the steps of: monitoring a sum of the temperature of the group of components between the gelling station and the second coat station and the temperature of the fluidized bed of thermoplastic powder; and maintaining the temperature sum within a predetermined temperature range. In a further detailed embodiment, the maintaining step includes the step of, responsive to the monitoring step, adjusting at least one of the gelling oven temperature and the temperature of the fluidized bed of thermoplastic powder. In yet a further detailed embodiment, the predetermined temperature range is approximately 325° F. to approximately 340° F.

In another alternate detailed embodiment of the second aspect of the present invention, the step of pre-heating the fluidized bed of thermoplastic powder includes the steps of injecting a gas into the fluidized bed and heating the gas prior to the injecting step. In a further detailed embodiment, the injecting step also performs, at least in part, the step of fluidizing the thermoplastic powder contained within the bed.

In another alternate detailed embodiment of the second aspect of the present invention, the step of pre-heating the fluidized bed of thermoplastic powder includes the step of repeatedly immersing groups of heated components into the fluidized bed of thermoplastic powder.

In another alternate detailed embodiment of the second aspect of the present invention, the step of pre-heating the fluidized bed of thermoplastic powder includes the steps of injecting a gas into the fluidized bed, heating the gas prior to the injecting step, and repeatedly immersing groups of the heated components into the fluidized bed of thermoplastic powder.

In another alternate detailed embodiment of the second aspect of the present invention, the batch method further includes the step of maintaining the fluidized bed of thermoplastic powder at a predetermined temperature range. In a further detailed embodiment, the predetermined temperature range is dependent at least in part, upon the temperature of the group of components between the gelling station and the second coat station. In an alternate detailed embodiment, the partially curing step includes the step of heating the group of components with the first coat in a gelling oven for a predetermined period of time and, during the pre-heating step, the temperature of the gelling oven is adjusted according, at least in part, to the temperature of the fluidized bed of thermoplastic powder.

In another alternate detailed embodiment of the second aspect of the present invention, the pre-heating step pre-heats the fluidized bed of thermoplastic powder to a temperature of approximately 90° F. to approximately 180° F.

In another alternate detailed embodiment of the second aspect of the present invention, the batch method further includes the step of removing excess of the thermoplastic powder from the component. In a further detailed embodiment, the removing step is performed at, or immediately after, the second coat station. In yet a further detailed embodiment, the removing step includes the step of directing at least one stream of gas against the component.

In another alternate detailed embodiment of the second aspect of the present invention, the first coat of epoxy-based, protective powder is a zinc-rich epoxy-based, protective powder.

It is a third aspect of the present invention to provide a method for applying a thermoplastic, protective coat to an automotive component that includes the steps of heating the automotive component; heating a fluidized bed of thermoplastic powder to be within a predetermined temperature difference from the heated automotive component; and immersing the heated automotive component within the heated fluidized bed of thermoplastic powder. In a detailed embodiment, the predetermined temperature difference is approximately 60° F. to approximately 75° F. In yet a further detailed embodiment, the temperature of the automotive component is approximately 200° F. to approximately 210° F. and the temperature of the fluidized bed of thermoplastic powder is approximately 135° F. to approximately 145° F.

It is a fourth aspect of the present invention to provide a method for applying a dual-layer protective coating to a steel component of a vehicle that includes the steps of: applying a first coat of epoxy-based, protective powder to the component; partially curing the first coat on the component in an oven at a first temperature; immersing the component with the partially cured first coat in a fluidized bed of thermoplastic powder heated at a second temperature to provide a second coat on the component; finally curing the first and second coats on the component; and repeating the applying, partially curing, immersing and finally curing steps for a plurality of the components while controlling the thickness of the second coat by maintaining a sum of the first and second temperatures within a predetermined temperature range. In a further detailed embodiment, the maintaining step includes the steps of detecting the first temperature, detecting the second temperature, and adjusting at least one of the first and second temperatures if the sum of the first and second temperatures falls outside of the predetermined temperature range. In yet a further detailed embodiment, the detecting and adjusting steps are automatic; or, alternatively, the adjusting step is manual.

In an alternate detailed embodiment of the fourth aspect of the present invention, the predetermined temperature range is approximately 435° F. to approximately 455° F., achieving a seconds coat thickness of approximately 13 mils to 17 mils. In a further detailed embodiment, the first temperature is approximately 300° F. to approximately 350° F. and the second temperature is approximately 135° F. to approximately 145° F.

It is a fifth aspect of the present invention to provide a method for applying a protective coating to a metallic component of a vehicle that includes the steps of: applying a first coat of epoxy-based, protective powder to the component; immersing the component with the partially first coat into the heated fluidized bed of thermoplastic powder so as to apply a second coat of the thermoplastic powder over the first coat; withdrawing the component from the fluidized bed; during or after the withdrawing step, actively removing excess thermoplastic powder from the component; and finally curing the first and second coats. In a detailed embodiment, the step of actively removing excess thermoplastic powder from the component includes the step of directing at least one stream of gas against the component.

BRIEF DESCRIPTION OF THE DRAWINGS

The Figure is a schematic diagram of an exemplary station configuration or flow diagram for performing an exemplary embodiment of a method according to the present invention.

DETAILED DESCRIPTION OF THE INVENTION

Figure 1:
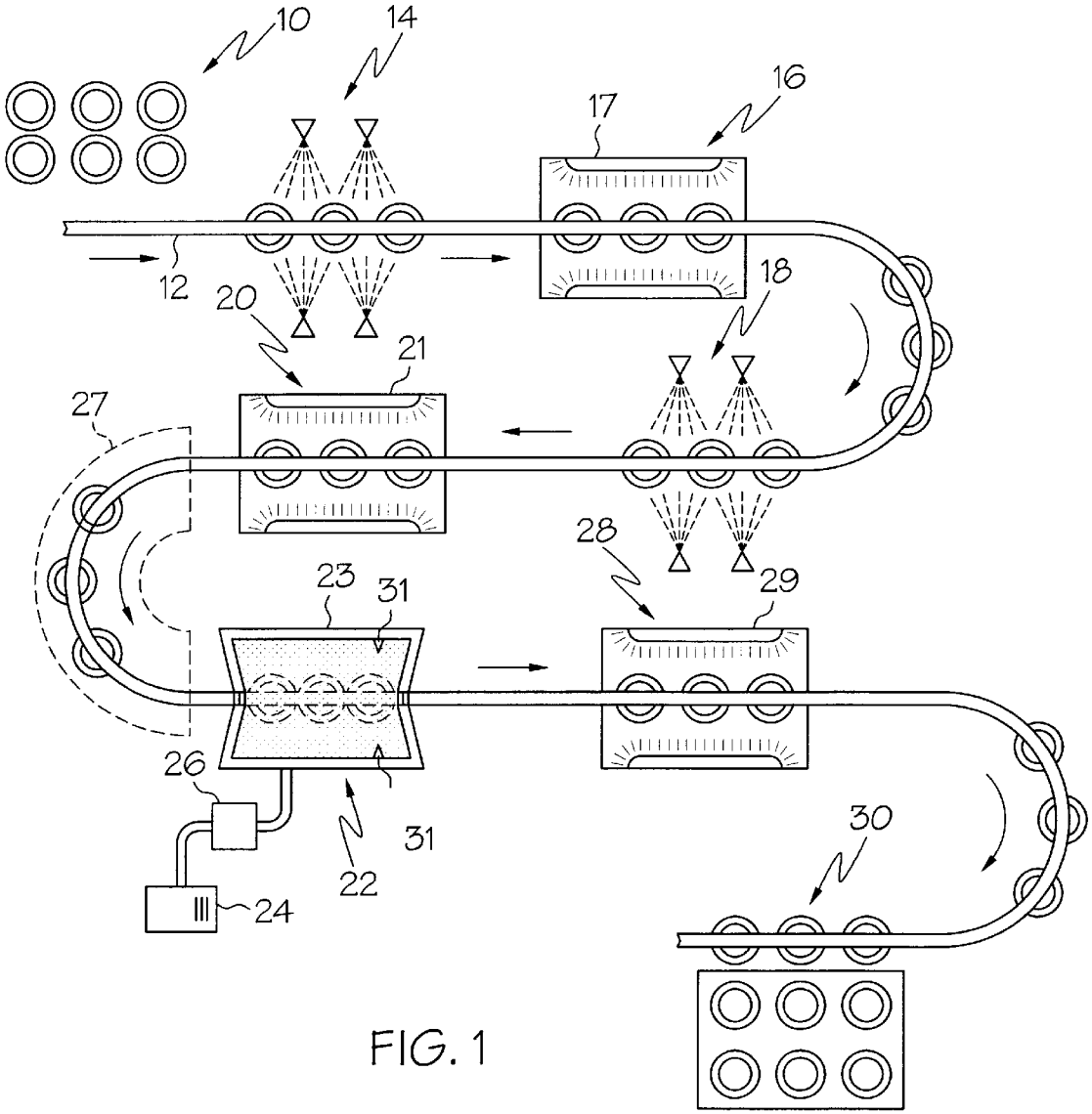

Referring to the attached Figure, in which the process is illustrated in further detail, automotive suspension components, such as steel coil-springs 10, are hung in batches or groups on a conveyor 12, which takes the groups of springs 10 through the various stages of the process. The first stage of the process is to pre-treat or wash the springs in a pre-treating station 14, where the springs 10 are sprayed with several different stages of cleaning and conditioning chemicals and fluids as will be known to those of ordinary skill in the art. Advancing to the next station 16, the springs are dried in a convection dry-off oven 17. Advancing to the first coat station 18, zinc-rich, epoxy-based powder (gray zinc-rich primer, in the exemplary embodiment, that is commercially available as Corvel Zinc Rich Gray (Product Code#13-7004), from Morton Powder Coatings, a Division of Rohm & Haas) is applied to the springs utilizing an electrostatic spray application. In the exemplary embodiment, the spray booth of the first coat station 18 utilizes four automatic sprayers (flow rate–45, atomization–50, KV's–90) and two manual spray guns (flow rate–35, atomization–40, KV's–80). The thickness of this initial coat of epoxy-based, zinc-rich powder in the exemplary embodiment is approximately 2.00 to approximately 3.00 mils.

Advancing to the gelling station 20, the epoxy-based, zinc-rich primer layer is partially cured in a convection oven 21 (also referred to as the "gelling oven") so that the zinc-rich primer layer is gelled. In the exemplary embodiment, the object of this gelling station is to approach approximately 50% curing of the epoxy-based, zinc-rich primer layer. In this partial curing step, this epoxy-based, zinc-rich layer is heated at a temperature that is substantially lower than the conventional curing temperatures for the prior art dual-layer coatings. More specifically, this partial-curing temperature is approximately 300° F. to approximately 350° F., and the components are subjected to this low temperature for approximately 600 seconds to approximately 700 seconds. In a specific exemplary embodiment (assuming the fluid bed, described below, is preheated to approximately 140° F.), the partial curing temperature is set to 300° F. and the springs are subjected to this temperature for approximately 630 seconds. In this station, the springs are heated to a temperature of approximately 140° F. to approximately 230° F.; and, in the specific embodiment, are heated to a temperature of approximately 205° F.

While it is an object to approach 50% curing of the epoxy-based, zinc-rich in the gelling station of the exemplary embodiment, it is to be understood that it is within the scope of the present invention to utilize other partial curing percentages.

Advancing to the second coat station 22, the springs with the gelled coat of epoxy-based, zinc-rich primer are immersed in a fluidized bed 23 of the thermoplastic powder (the thermoplastic powder is commercially available, in the exemplary embodiment, as Corvel Black 20 (Product Code#DG-7001) from Morton Powder Coatings). In the exemplary embodiment, approximately 5000 lbs of the thermoplastic powder is fluidized by injecting air into the bed 23 utilizing a blower 24. This air, in the exemplary embodiment, is heated by passing the air through a heater 26. By heating the fluidized thermoplastic powder, the temperature of the powder will begin to approach the temperature of the springs prior to the springs being immersed within the fluidized powder, such that the potential between these two temperatures is maintained at a predetermined level.

In the exemplary embodiment, the springs are at a temperature of approximately 205° F. before being immersed into the fluidized powder, which is pre-heated or heated to a temperature of approximately 140° F. Therefore, in this exemplary embodiment, the potential is approximately 65° F. Nevertheless, it is within the scope of the certain broader aspects of the invention to keep this potential at approximately 60° F. to approximately 75° F. This potential may be monitored and adjusted by an automatic temperature sensing and control system or may be manually monitored and adjusted.

Furthermore, while the fluidized powder, in the exemplary embodiment is pre-heated or heated to a temperature of approximately 140° F., it is within the scope of a broader aspect of the invention to pre-heat or heat the fluidized powder to temperature anywhere in the range of approximately 135° F. to approximately 145° F.; and it is within the scope of an even broader aspect of the invention to pre-heat or heat the fluidized bed to a temperature anywhere in the range of approximately 90° F. to approximately 180° F. Likewise, while the temperature of the spring just before being immersed in the fluidized powder, in the exemplary embodiment, is approximately 205° F., it is within the scope of a broader aspect of the invention that the temperature of the spring just prior to immersion is a temperature anywhere in the range of approximately 200° F. to approximately 210° F.; and it is within the scope of an even broader aspect of the invention that the temperature of the spring just prior to immersion is a temperature anywhere in the range of approximately 140° F. to approximately 230° F.

Additionally, while the exemplary embodiment utilizes the heater 26 to heat the gas or air injected into the fluidized bed 23, it is within the scope of the invention to utilize alternate or additional ways or mechanism to pre-heat or heat the fluidized powder. For example, it is within the scope of the invention to utilize a heated water-jacket positioned within or around the bed 23. As another example, continuous immersions of groups or batches of the heated springs into the fluidized powder will provide substantial heat to the thermoplastic powder. Therefore, in a continuous batch process envisioned by the exemplary embodiment, the continuous immersions of groups or batches of the heated springs into the fluidized powder inherently assists in the heating process of the fluidized powder. While it is within the scope of certain aspects of the invention to use the continuous immersions of groups or batches of the heated springs into the fluidized powder as the sole means to heat or pre-heat the fluidized powder, this will likely cause an initial number of the batches to be wasted (insufficiently coated) while the temperature of the fluidized powder is being increased.

It is within the scope of certain aspects of the present invention to provide a shroud 27, a housing or some other thermal protection between the gelling oven 21 and the fluidized bed 23 for the purpose of assisting in keeping the temperature of the springs just prior to being immersed in the fluidized bed 23 consistent. Another way of achieving this is to decrease the distance of travel between the gelling oven 21 and the fluidized bed 23.

It has been found that the thickness of the thermoplastic coat may be controlled by detecting the air temperature in the gelling oven 21 and the temperature in the fluid bed 23 and arithmetically adding the two temperatures together. The sum of the two temperatures is proportional to the thickness of the thermoplastic coat. Consequently, knowing that a predetermined sum of the two temperatures achieves a certain thickness (or a thickness within a given range), the two temperatures can be separately monitored and adjusted (either manually or automatically) to maintain the sum. In the exemplary embodiment, it has been found that a temperature sum in the range of approximately 435° F. to approximately 455° F. will achieve a desired thickness of the outer thermoplastic coat to be in the range of approximately 13 mils to approximately 17 mils (based upon an arithmetic average of all coated surfaces of the spring). It is also within the scope of the invention to monitor and control the sum of the spring temperature prior to being immersed in the fluidized bed 23 with the temperature of the bed. A range of is approximately 325° F. to approximately 340° F. for this sum should achieve the desired thickness of the outer thermoplastic coat to be in the range of approximately 13 miles to approximately 17 mils (based upon an arithmetic average of all coated surfaces of the spring).

Before leaving the second coat station 22, the springs are withdrawn from the fluidized bed 23 of thermoplastic powder and air nozzles 31 are used to blow the excess thermoplastic powder from the surfaces of the springs. This lowers thermoplastic powder consumption and allows for a more uniform thermoplastic coating thickness.

From the second coat station 22, the springs are then taken to final curing station 28 where the inner and outer layers of the dual-layer coating are finally cured in a convection oven 29. Preferably, this oven 29 is maintained at a temperature ranging from approximately 300° F. to approximately 330° F. and the springs are maintained within this oven 29 for approximately 830 seconds to approximately 900 seconds. While the station is referred to a "final curing station" it will be understood to those of ordinary skill that additional curing of the layers may continue upon leaving the station. Advancing to the finishing station 30 the springs are allowed to cool down at ambient temperature, tape is placed on the parts to label the springs, the springs are unracked and other pre-shipping steps are performed on the springs.

Following from the above description and invention summaries, it should be apparent to those of ordinary skill in the art that, while the processes and systems herein described constitute exemplary embodiments of the present invention, it is understood that the inventions contained herein are not limited to these precise processes and systems and that changes may be made to them without departing from the scope of the inventions as defined by the claims. For example, while the exemplary embodiment of the present invention discusses the dual-coat process for steel coil springs from an automotive suspension system, the dual-coat process of the present invention may be used for other types of metallic components needing protection from corrosion and the environment.

Additionally, it is to be understood that the invention is defined by the claims and it is not intended that any limitations or elements describing the exemplary embodiments set forth herein are to be incorporated into the meanings of the clams unless such limitations or elements are explicitely listed in the claims. Likewise, it is to be understood that it is not necessary to meet any or all of the identified advantages or objects of the inventions disclosed herein in order to fall to within the scope of any claims, since the invention is defined by the claims and since inherent and/or unforeseen advantages of the present invention may exist even though they may not have been explicitly discussed herein.

What is claimed is:

1. A method for applying a protective coating to a metallic component of a vehicle comprising the steps of:

applying a coat of epoxy-based, protective powder to the component;

partially curing the coat of epoxy-based, protective powder;

heating a fluidized bed of thermoplastic powder;

immersing the component with the partially cured coat of epoxy-based, protective powder into the heated fluidized bed of thermoplastic powder so as to apply a coat of the thermoplastic powder over the coat of epoxy-based, protective powder, wherein the fluidized bed of thermoplastic powder is heated to bring the fluidized bed of thermoplastic powder within a predetermined temperature difference from the temperature of the component at a time just prior to the immersing step;

withdrawing the component from the fluidized bed;

finally curing the coat of epoxy-based, protective powder and the coat of the thermoplastic powder;

monitoring the temperature difference between the fluidized bed of thermoplastic powder and the component at the time just prior to the immersing step; and responsive to the monitoring step, adjusting at least one of the temperature of the fluidized bed of thermoplastic powder and the temperature of the component at the time just prior to the immersing step.

2. The method of claim 1, wherein the adjusting step is performed automatically.

3. The method of claim 1, wherein the adjusting step is performed, at least in part, manually.

4. The method of claim 1, wherein the predetermined temperature difference is approximately 60° F. to approximately 75° F.

5. The method of claim 1, wherein the temperature of the component at the time just prior to the immersing step is approximately 140° F. to approximately 230° F. and the temperature of the fluidized bed of thermoplastic powder is approximately 90° F. to approximately 180° F.

6. The method of claim 5, wherein the temperature of the component at the time just prior to the immersing step is approximately 200° F. to approximately 210° F. and the temperature of the fluidized bed of thermoplastic powder is approximately 135° F. to approximately 145° F.

7. The method of claim 1, wherein the heating step includes the step of pre-heating the fluidized bed of thermoplastic powder and the method further includes the step of maintaining the fluidized bed of thermoplastic powder at a predetermined temperature range.

8. The method of claim 7, wherein the predetermined temperature range is dependent, at least in part, upon the temperature of the component at a time just prior to the immersing step.

9. The method of claim 7, wherein the pre-heating step pre-heats the fluidized bed of thermoplastic powder to a temperature of approximately 90° F. to approximately 180° F.

10. A method for applying a protective coating to a metallic component of a vehicle comprising the steps of:

applying a coat of epoxy-based, protective powder to the component;

partially curing the coat of epoxy-based, protective powder, wherein the partially curing step includes the step of heating the component with the coat of epoxy-based, protective powder applied thereto in an oven at a predetermined temperature for a predetermined period of time;

heating a fluidized bed of thermoplastic powder;

immersing the component with the partially cured coat of epoxy-based, protective powder into the heated fluidized bed of thermoplastic powder so as to apply a coat of the thermoplastic powder over the coat of epoxy-based, protective powder;

withdrawing the component from the fluidized bed;

finally curing the coat of epoxy-based, protective powder and the coat of the thermoplastic powder;

monitoring a sum of the oven temperature and the temperature of the fluidized bed of thermoplastic powder; and maintaining the sum of the oven temperature and the temperature of the fluidized bed of thermoplastic powder within a predetermined temperature range.

11. The method of claim 10, wherein the maintaining step includes the step of:

responsive to the monitoring step, adjusting at least one of the oven temperature and the temperature of the fluidized bed of thermoplastic powder.

12. The method of claim 10, wherein the predetermined temperature range is approximately 435° F. to approximately 455° F.

13. A method for applying a protective coating to a metallic component of a vehicle comprising the steps of:

applying a coat of epoxy-based, protective powder to the component;

partially curing the coat of epoxy-based, protective powder, wherein the partially curing step includes the step of heating the component with the coat of epoxy-based, protective powder applied thereto in an oven at a predetermined temperature for a predetermined period of time;

heating a fluidized bed of thermoplastic powder;

immersing the component with the partially cured coat of epoxy-based, protective powder into the heated fluidized bed of thermoplastic powder so as to apply a coat of the thermoplastic powder over the coat of epoxy-based, protective powder;

withdrawing the component from the fluidized bed;

finally curing the coat of epoxy-based, protective powder and the coat of the thermoplastic powder;

monitoring a sum of the component temperature at the time just prior to the immersing step and the temperature of the fluidized bed of thermoplastic powder; and maintaining the sum of the component temperature at the time just prior to the immersing step and the temperature of the fluidized bed of thermoplastic powder within a predetermined temperature range.

14. The method of claim 13, wherein the maintaining step includes the step of:

responsive to the monitoring step, adjusting at least one of the oven temperature and the temperature of the fluidized bed of thermoplastic powder.

15. The method of claim 14, wherein the predetermined temperature range is approximately 325° F. to approximately 340° F.

16. A batch method for applying a protective coating to multiple groups of steel components for a vehicle comprising the steps of:

applying a coat of epoxy-based, protective powder to a group of the components at a first coat station;

partially curing the coat of epoxy-based, protective powder on the group of the components at a gelling station;

pre-heating a fluidized bed of thermoplastic powder, wherein the fluidized bed of thermoplastic powder is pre-heated to bring the fluidized bed of thermoplastic powder within a predetermined temperature difference from the temperature of the group of components as detected between the gelling station and the second coat station;

immersing the group of the components with the partially cured coat of epoxy-based, protective powder into the pre-heated fluidized bed of thermoplastic powder so as to apply a coat of the thermoplastic powder over the coat of epoxy-based, protective powder at a second coat station;

finally curing the coat of epoxy-based, protective powder and the coat of the thermoplastic powder on the group of components, at least in part, at a curing station;

monitoring the temperature difference between the fluidized bed of thermoplastic powder and the group of components as detected between the gelling station and the second coat station; and responsive to the monitoring step, adjusting at least one of the temperature of the fluidized bed of thermoplastic powder and the temperature of the group of components as detected between the gelling station and the second coat station.

17. The batch method of claim 16, wherein the adjusting step is performed automatically.

18. The batch method of claim 16, wherein the adjusting step is performed, at least in part, manually.

19. A batch method for applying a protective coating to multiple groups of steel components for a vehicle comprising the steps of:

applying a coat of epoxy-based, protective powder to a group of the components at a first coat station;

partially curing the coat of epoxy-based, protective powder on the group of the components at a gelling station, wherein the gelling station utilizes a gelling oven at a predetermined temperature for a predetermined period of time;

pre-heating a fluidized bed of thermoplastic powder;

immersing the group of the components with the partially cured coat of epoxy-based, protective powder into the pre-heated fluidized bed of thermoplastic powder so as to apply a coat of the thermoplastic powder over the coat at a second coat station;

finally curing, at least in part, the coat of epoxy-based, protective powder and the coat of the thermoplastic powder on the group of components at a curing station;

monitoring a sum of the gelling oven temperature and the temperature of the fluidized bed of thermoplastic powder; and maintaining the sum of the gelling oven temperature and the temperature of the fluidized bed of thermoplastic powder within a predetermined temperature range.

20. The batch method of claim 19, wherein the maintaining step includes the step of:

responsive to the monitoring step, adjusting at least one of the gelling oven temperature and the temperature of the fluidized bed of thermoplastic powder.

21. The batch method of claim 19, wherein the predetermined temperature range is approximately 435° F. to approximately 455° F.

22. A batch method for applying a protective coating to multiple groups of steel components for a vehicle comprising the steps of:

applying a coat of epoxy-based, protective powder to a group of the components at a first coat station;

partially curing the coat of epoxy-based, protective powder on the group of the components at a gelling station, wherein the gelling station utilizes a gelling oven at a predetermined temperature for a predetermined period of time;

pre-heating a fluidized bed of thermoplastic powder;

immersing the group of the components with the partially cured coat of epoxy-based, protective powder into the pre-heated fluidized bed of thermoplastic powder so as to apply a coat of the thermoplastic powder over the coat of epoxy-based, protective powder at a second coat station;

finally curing the coat of epoxy-based, protective powder and the coat of the thermoplastic powder on the group of components, at least in part, at a curing station;

monitoring a sum of the temperature of the group of components between the gelling station and the second coat station and the temperature of the fluidized bed of thermoplastic powder; and maintaining the temperature sum within a predetermined temperature range.

23. The batch method of claim 22, wherein the maintaining step includes the step of.

responsive to the monitoring step, adjusting at least one of the gelling oven temperature and the temperature of the fluidized bed of thermoplastic powder.

24. The batch method of claim 23, wherein the predetermined temperature range is approximately 325° F. to approximately 340° F.

25. A method for applying a dual-layer protective coating to a steel component of a vehicle comprising the steps of:

applying a first coat of epoxy-based, protective powder to the component;

partially curing the first coat on the component in an oven at a first temperature;

immersing the component with the partially cured first coat in a fluidized bed of thermoplastic powder heated at a second temperature to provide a second coat on the component;

finally curing the first and second coats on the component; and repeating the applying, partially curing, immersing and finally curing steps for a plurality of the components while controlling the thickness of the second coat by maintaining a sum of the first and second temperatures within a predetermined temperature range.

26. The method of claim 25, wherein the maintaining step includes the steps of:

detecting the first temperature;

detecting the second temperature; and adjusting at least one of the first and second temperatures if the sum of the first and second temperatures falls outside of the predetermined temperature range.

27. The method of claim 26, wherein the detecting and adjusting steps are automatic.

28. The method of claim 26, wherein the adjusting step is manual.

29. The method of claim 25, wherein the predetermined temperature range is approximately 435° F. to approximately 455° F., achieving a second coat thickness of approximately 13 mils to approximately 17 mils.

30. The method of claim 25, wherein the first temperature is approximately 300° F. to approximately 350° F. and the second temperature is approximately 135° F. to approximately 145° F.

31. A method for applying a protective, dual-layer coating to a component of a vehicle comprising the steps of:

applying a coat of first-coat powder to the component;

partially curing the coat of first-coat powder;

heating a fluidized bed of second-coat powder, wherein the fluidized bed of second-coat powder is heated so as to bring the fluidized bed of thermoplastic powder within a predetermined temperature difference from the temperature of the component at a time just prior to the immersing step;

immersing the component with the partially cured coat of first-coat powder into the heated fluidized bed of second-coat powder so as to apply a coat of the second-coat powder over the coat of first-coat powder;

withdrawing the component from the fluidized bed;

finally curing the coat of first-coat powder and the coat of the second-coat powder;

monitoring the temperature difference between the fluidized bed of second-coat powder and the component at the time just prior to the immersing step; and responsive to the monitoring step, adjusting at least one of the temperature of the fluidized bed of second-coat powder and the temperature of the component at the time just prior to the immersing step.

32. A method for applying a protective, dual-layer coating to a component of a vehicle comprising the steps of:

applying a coat of first-coat powder to the component;

partially curing the coat of first-coat powder, wherein the partially curing step includes the step of heating the component with the coat of first-coat powder applied thereto in an oven at a predetermined temperature for a predetermined period of time;

heating a fluidized bed of second-coat powder;

immersing the component with the partially cured coat of first-coat powder into the heated fluidized bed of second-coat powder so as to apply a coat of the second-coat powder over the coat of first-coat powder;

withdrawing the component from the fluidized bed;

finally curing the coat of first-coat powder and the coat of the second-coat powder;

monitoring a sum of the oven temperature and the temperature of the fluidized bed of second-coat powder; and maintaining the sum of the oven temperature and the temperature of the fluidized bed of second-coat powder within a predetermined temperature range.

33. The method of claim 32, wherein the maintaining step includes the step of:

responsive to the monitoring step, adjusting at least one of the oven temperature and the temperature of the fluidized bed of second-coat powder.

34. A method for applying a protective, dual-layer coating to a component of a vehicle comprising the steps of:

applying a coat of first-coat powder to the component;

partially curing the coat of first-coat powder;

heating a fluidized bed of second-coat powder;

immersing the component with the partially cured coat of first-coat powder into the heated fluidized bed of second-coat powder so as to apply a coat of the second-coat powder over the coat of first-coat powder;

withdrawing the component from the fluidized bed;

finally curing the coat of first-coat powder and the coat of the second-coat powder;

monitoring a sum of the component temperature at the time just prior to the immersing step and the temperature of the fluidized bed of second-coat powder; and maintaining the sum of the component temperature at the time just prior to the immersing step and the temperature of the fluidized bed of second-coat powder within a predetermined temperature range.

35. The method of claim 34, wherein the maintaining step includes the step of:

responsive to the monitoring step, adjusting at least one of the oven temperature and the temperature of the fluidized bed of second-coat powder.

* * * * *